US005597286A

United States Patent [19]

Dawson et al.

[11] Patent Number: 5,597,286

[45] Date of Patent: Jan. 28, 1997

[54] TURBINE FRAME STATIC SEAL

[75] Inventors: John Dawson, Boxford; John J. Patrikus, Salem, both of Mass.

[73] Assignee: General Electric Company, Cincinnati, Ohio

[21] Appl. No.: 576,146

[22] Filed: Dec. 21, 1995

[51] Int. Cl.[6] ..... F01D 11/00

[52] U.S. Cl. ..... 415/115; 415/134; 415/142

[58] Field of Search ..... 415/115, 134, 415/136, 138, 142

[56] References Cited

U.S. PATENT DOCUMENTS 2,744,722 5/1956 Orr ..... 415/115

4,197,702 4/1980 Robertson ..... 415/142

4,478,551 10/1984 Honeycutt, Jr. et al. ..... 415/142

5,272,869 12/1993 Dawson et al. ..... 415/142

*Primary Examiner*—James Larson

*Attorney, Agent, or Firm*—Andrew C. Hess; Wayne O. Traynham

[57] ABSTRACT

A seal is provided between an inner flowpath and inner band of a turbine frame for confining cooling air channeled therebetween. The seal includes a frustoconical seal support and a radially outer seal ring integrally joined to a smaller diameter distal end of the support. A radially inner ring is fixedly joined to the inner band coaxially with the outer ring and is spaced radially inwardly thereof to define a gap therebetween sized for limiting leakage of cooling air from a chamber defined between the seal and inner flowpath.

10 Claims, 3 Drawing Sheets

TURBINE FRAME STATIC SEAL

The US Government has rights in this invention in accordance with contract N00019-92-C-0149 awarded by the Department of the Navy.

BACKGROUND OF THE INVENTION

The present invention relates generally to gas turbine engines, and, more specifically, to sealed turbine frames therein.

In a typical gas turbine engine, air is compressed in a compressor, mixed with fuel and ignited to produce combustion gases in a combustor, and channeled downstream through one or more stages of turbine nozzles and rotor blades. The rotor blades extend radially outwardly from a disk which is joined to a shaft for powering the compressor or fan. The shaft is supported by bearings from a bearing support which forms part of a turbine frame.

An exemplary turbine frame disposed downstream of a last rotor stage for example, includes a plurality of circumferentially spaced apart supporting struts which extend radially between inner and outer annular bands. The bearing support is fixedly joined to the inner band, and the outer band is fixedly joined to an outer casing of the engine.

Surrounding each of the struts is a hollow fairing which is suitably provided with pressurized cooling air bled from the compressor for cooling the turbine frame from the heating effects of the hot combustion gases which flow axially therethrough. The fairings are joined at their inner and outer ends to annular members defining corresponding inner and outer flowpaths between which the combustion gases flow. With each of the fairings suitably surrounding respective ones of the struts, the fairing assembly is allowed to float relative thereto with unrestrained differential thermal expansion and contraction movement. During operation, the fairings are directly bathed in the combustion gases and therefore expand radially outwardly at a greater rate than the struts protected therein. The cooling air channeled through the fairings cools the fairings as well as the struts and further affects the differential thermal movement between the fairings and the struts.

Since the inner flowpath is joined to the fairings and is itself subject to heating by the combustion gases, it also expands and contracts at a different rate than that of the struts. Since the cooling air is channeled radially inwardly through the fairings and the inner flowpath, suitable seals are required to prevent or control leakage from the cooling circuit of the turbine frame while permitting or accommodating differential thermal movement between the components.

In one conventional design, an inner cylindrical ring forms an extension of the bearing support and extends axially forwardly from the inner band of the struts. A generally T-section annular sliding axial seal surrounds the inner ring, with the head of the T forming a seal therewith. The base of the T extends radially outwardly and defines a tongue which is radially received in an annular groove of a radial seal which is fixedly joined to the fairing inner flowpath. In this arrangement, the radial seal accommodates differential radial expansion and contraction between the inner flowpath and the bearing support, and the axial seal accommodates axial differential movement therebetween.

Both these radial and axial seals are subject to frictional wear during operation as the components thereof slide during differential movement, which results in increased leakage through the seals over time. Accordingly, additional cooling air must be provided, which correspondingly decreases the overall engine efficiency. And, the double seal assembly is relatively complex and includes several components which require separate manufacturing processes, with attendant cost thereof.

SUMMARY OF THE INVENTION

A seal is provided between an inner flowpath and an inner band of a turbine frame for confining cooling air channeled therebetween. The seal includes a frustoconical seal support and a radially outer seal ring integrally joined to a smaller diameter distal end of the support. A radially inner ring is fixedly joined to the inner band coaxially with the outer ring and is spaced radially inwardly thereof to define a gap therebetween sized for limiting leakage of cooling air from a chamber defined between the seal and inner flowpath.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
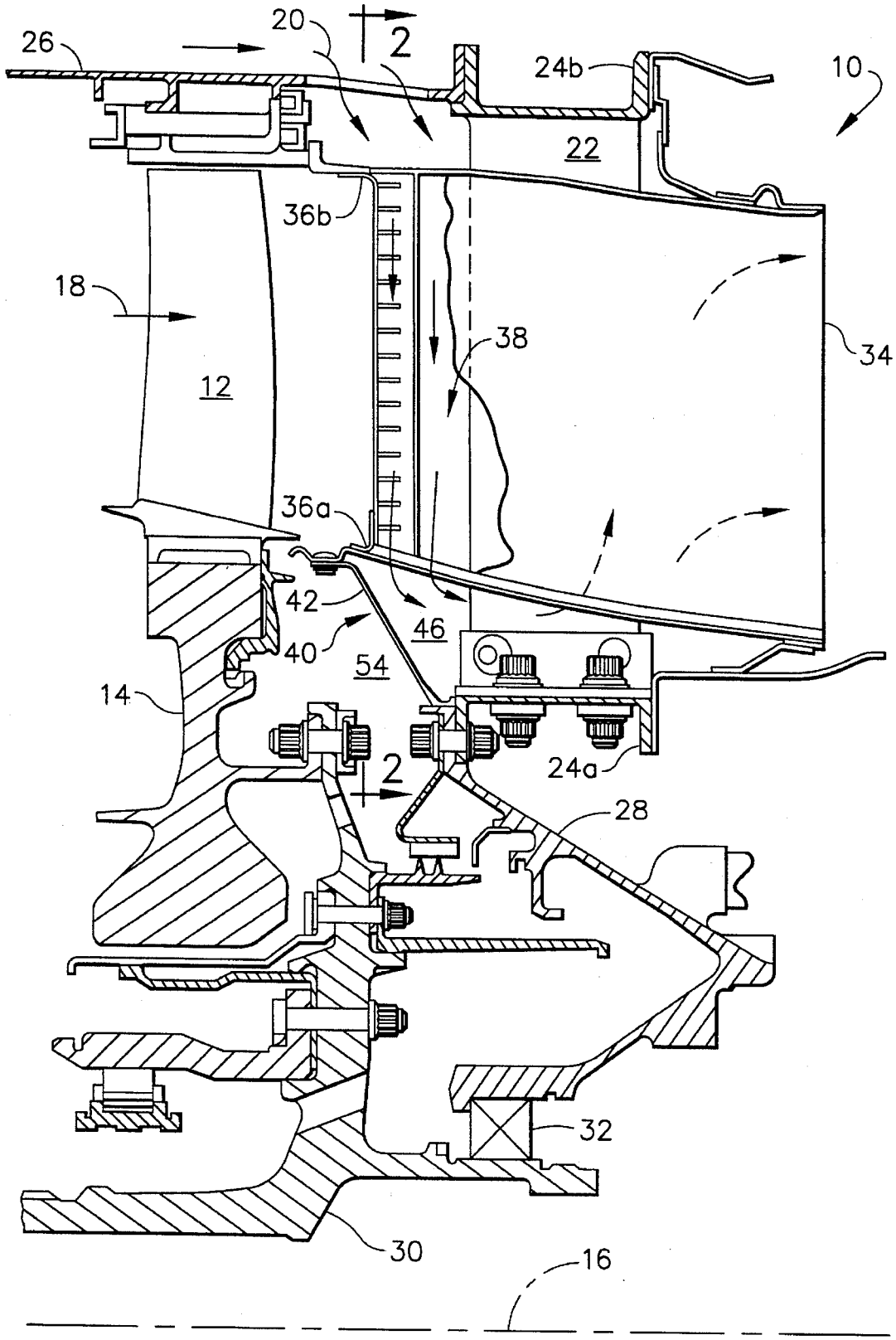
FIG. 1 is an elevational, partly sectional view of an exemplary turbine frame having an improved static seal therein, in accordance with one embodiment of the present invention, disposed downstream from a turbine rotor stage in a gas turbine engine.
Figure 2:
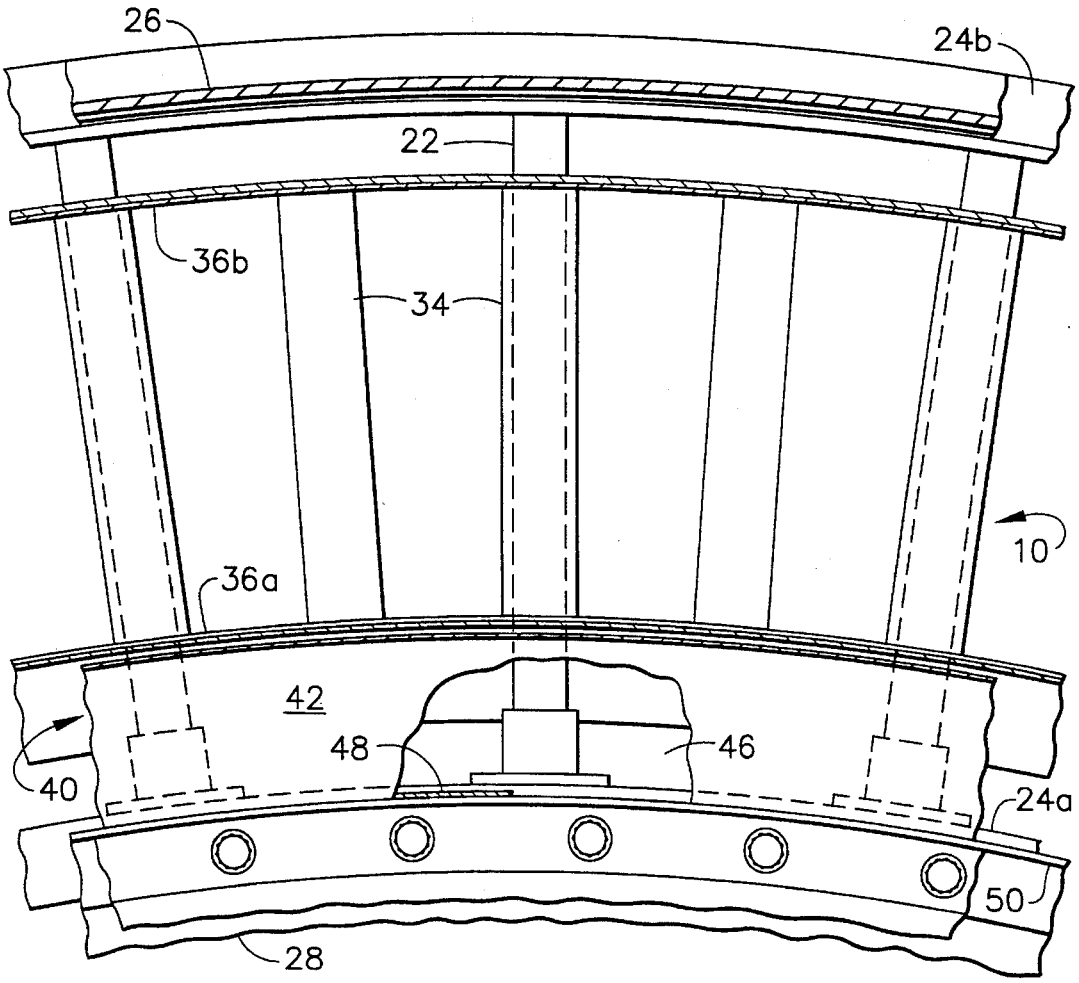
FIG. 2 is an elevational, partly sectional view of a portion of the turbine frame illustrated in FIG. 1 and taken generally along line 2—2 for illustrating one embodiment of the static seal extending between an inner flowpath and inner band of the frame.

Illustrated in FIGS. 1 and 2 is a turbine frame 10 of an exemplary gas turbine engine having last stage rotor blades 12 joined to a rotor disk 14. The frame 10 and disk 14 are disposed coaxially about a longitudinal or axial centerline axis 16 of the engine and receive in turn hot combustion gases 18 which are formed in a combustor thereof (not shown). A compressor (not shown) of the engine pressurizes air which is mixed with fuel and ignited in the combustor for generating the combustion gases 18. A portion of the pressurized air is conventionally bled from the compressor and channeled through the frame 10 as pressurized cooling air 20 which is used for cooling the turbine frame 10 in a conventional manner against the heating effects of the combustion gases 18.

The turbine frame 10 illustrated in FIGS. 1 and 2 includes a plurality of circumferentially spaced apart, radially extending support struts 22 which are fixedly joined at radially inner and outer bands 24*a*, 24*b*. The outer band 24*b* is fixedly joined to an annular outer casing 26 of the engine. The inner band 24*a* is fixedly joined to a suitable annular bearing support 28 which is in the exemplary form of two conical members. A rotor shaft 30 is suitably joined to the disk 14 and is mounted to the bearing support 28 by a conventional bearing 32. These struts 22 and bearing support 28 provide a relatively rigid assembly for carrying rotor loads to the outer casing 26 during operation of the engine.

Surrounding each of the struts 22 is a suitable fairing 34, with additional fairings 34 known as vanes being disposed between circumferentially adjacent struts 22 as required for channeling the combustion gases 18 downstream through the engine. The fairings 34 are fixedly joined at radially inner and outer ends thereof to corresponding annular inner and outer flowpaths 36*a,b*. The flowpaths 36*a,b* are annular members which confine the flow of the combustion gases 18 therebetween, and are therefore correspondingly heated thereby as the combustion gases 18 flow thereover. Respective ones of the fairings 34 surround corresponding struts 22 and are circumferentially joined together by the inner and outer flowpaths 36*a,b* which allows the fairings and flowpaths to be correspondingly supported by the struts 22 radially outwardly of the bearing support 28 for unrestrained differential thermal movement therewith. Suitable guides may be provided as required between the fairings 34 and the struts 22 for allowing the fairings 34 to expand and contract relative to the struts 22 without restraint therefrom in a conventional manner.

As shown in FIG. 1, the cooling air 20 is suitably channeled to the turbine frame 10 and passes through a suitable cooling circuit 38 therein which passes in part radially inwardly through the individual fairings 34 and through corresponding apertures through the inner flowpath 36*a* for channeling the cooling air 20 adjacent to the inner band 24*a*. In order to confine the cooling air 20 in the cooling circuit 38 below the inner flowpath 36*a* while allowing differential thermal movement between the inner flowpath 36*a* and the struts 22 during operation, a static seal 40 is provided in accordance with one embodiment of the present invention which is a simple assembly of few components which provide self correcting sealing during operation.

Figure 3:
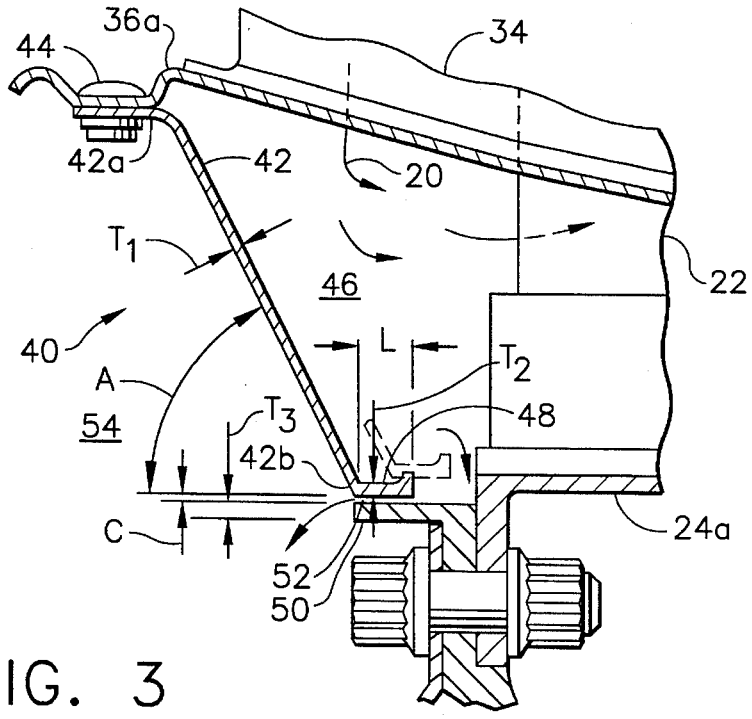
FIG. 3 is an enlarged, elevational, partly sectional view of the static seal illustrated in FIGS. 1 and 2 in accordance with one embodiment of the present invention.

More specifically, the seal 40 is illustrated in more particularity in FIG. 3 wherein it confines the pressurized cooling air 20 channeled radially inwardly through the fairings 34 in the region between the inner flowpath 36*a* and the inner band 24*a* at the bearing support 28. The seal 40 is an assembly of components including an imperforate frustoconical seal support 42 having a cylindrical proximal end 42*a* fixedly and sealingly joined to a corresponding forward end of the inner flowpath 36*a*. The mating surfaces thereof are simple cylinders which radially abut each other and are joined together by suitable fasteners, such as rivets 44, with the abutting joint providing an effective seal therebetween. The support 42 is coaxial about the centerline axis 16 as illustrated in FIG. 1, and further includes a distal end 42*b* as illustrated in FIG. 3 which is spaced axially aft from the proximal end 42*a* and has a smaller diameter compared thereto. The support 42 is spaced in most part radially inwardly from the inner flowpath 36*a* and radially outwardly from the bearing support 28 axially forwardly of the struts 22 to define an annular chamber 46 for receiving the pressurized cooling air 20 discharged from the fairings 34 through the inner flowpath 36*a*. A radially outer seal ring 48 is integrally joined coaxially with the support distal end 42*b*, and extends axially aft therefrom in this exemplary embodiment.

A radially inner seal ring 50 is fixedly joined to the turbine frame 10 at a suitable location adjacent to the inner band 24*a*, which in the exemplary embodiment illustrated in FIG. 3 is provided by making the inner ring 50 an integral portion of the radially outer end of the bearing support 28 which is bolted to the inner band 24*a*. The inner ring 50 is disposed coaxially with the outer ring 48 and is spaced radially inwardly thereof to define a predetermined radial gap 52 having a radial clearance C therebetween sized for limiting leakage of the cooling air 20 from the chamber 46 therethrough.

In the exemplary embodiment illustrated in FIG. 3, the outer and inner rings 48, 50 are cylindrical and concentric, and the gap 52 extends axially therebetween for a suitable length L. The gap 52 provides a controlled seal between the outer and inner rings to limit leakage therethrough.

The seal support 42 has an acute cone angle A predetermining sized to isolate or uncouple the outer ring 48 from thermal increase or decrease in diameter of the support proximal end 42*a*, which is fixedly joined to the inner flowpath 36*a*, for reducing radial expansion, as well as contraction, of the gap 52 during operation. The cone angle A may have any suitable value within the exemplary range of about 30°–60°, with 60° being illustrated.

Since the seal support 42 is a conical ring, it behaves in coupled three dimensions which is used in accordance with the present invention to isolate the outer ring 48 from the thermal movement of the inner flowpath 36*a* to which the seal support 42 is attached. As the diameter of the support proximal end 42*a* increases or decreases due to thermal expansion and contraction with the inner flowpath 36*a* during operation, the support distal end 42*b* moves primarily axially instead of radially. In this way, differential thermal movement between the inner flowpath 36*a* and the inner band 24*a* has reduced effect on the size of the gap 52 which controls the sealing effect thereof.

In the preferred embodiment illustrated in FIG. 3, both the seal support 42 and the outer ring 48 have corresponding thicknesses $T_1$ and $T_2$ which are selected to be relatively small for providing radial flexibility thereof for allowing the positive differential pressure of the cooling air 20 developed across the seal support 42 from the chamber 46 to elastically decrease the diameter of the outer ring 48 to correspondingly radially decrease the gap 52. In the exemplary embodiment illustrated, the thickness $T_1$ of the support 42 is about 20 mils, and the thickness $T_2$ of the outer ring 48 is about 40 mils.

The seal support 42 defines on one side the inner chamber 46 which receives the pressurized cooling air 20, and on the other side, an outer chamber 54 in the region between the rotor disk 14 and the bearing support 28 which experiences a lower pressure during operation of the engine. The differential pressure acting across the seal support 42 may therefore be used for reducing the clearance C of the gap 52 during operation in response to the increasing pressure of the cooling air 20 as the engine is operated at higher power levels. This provides a self correcting seal, with the gap 52 decreasing as the differential pressure increases for providing enhanced sealing in response to the engine cycle.

The outer and inner rings 48, 50 illustrated in FIG. 3 preferably have substantially equal cross sectional thermal mass areas for better matching thermal expansion and contraction movement response thereof during operation. The inner ring 50 has a radial thickness $T_3$ which is preferably equal to the thickness of the outer ring 48, with the outer and inner rings having generally equal axial length where they are unsupported and relatively free to expand and contract radially. The outer ring 48 preferably has a lower coefficient of thermal expansion than that of the inner ring 50 for decreasing the gap 52 at increasing temperature of the outer and inner rings 48, 50. In the exemplary embodiment, the seal supp 2 and outer ring 48 are formed of conventional HS188, with the inner ring 50 being formed of conventional INCO 718 from which the bearing support 28 is made.

Furthermore, the outer ring 48 is preferably integrally joined at its forward end directly to the distal end 42*b* of the seal support 42, and extends axially outwardly aft or away from the seal support 42 to define an obtuse intersection angle therewith. In this way, the outer ring 48 defines in part the inner chamber 46, and its outer surface is pressurized by the cooling air 20 during operation. Accordingly, the outer ring 48 is exposed to both the pressure and temperature of the cooling air 20 from the inner chamber 46, whereas the inner ring 50 is exposed primarily to the pressure and temperature of the outer chamber 54.

When the components of the seal 40 are initially assembled cold, the outer ring 48 has a nominal position shown in phantom line in FIG. 3 closely adjacent to the inner band 24*a*, with a corresponding initial value of the clearance C which is about 5 mils for example. When the engine is started and brought to idle, both the outer and inner rings 48 and 50 are heated, with the differences in thermal coefficients of expansion initially further decreasing the clearance C to about 4.5 mils for example. As the engine is operated with increasing power, up to cruise power level for example, the corresponding increase in the pressure of the cooling air 20 creates a pressure force acting radially inwardly on the seal support 42 and outer ring 48 which further decreases the clearance C to about a 1 mil clearance at steady state operation.

During an acceleration burst, with the turbine rotor 14 increasing in speed, the temperature, and therefore the diameter, of the inner flowpath 36*a* increases relative to the inner band 24*a* and inner ring 50, but the isolating effect of the seal support 42 prevents a corresponding increase in diameter of the outer ring 48 which instead moves axially forwardly away from the inner band 24*a*. The outer ring 48 will nevertheless increase in diameter transiently since the outer ring 48 transiently increases in temperature at a greater rate than that of the inner ring 50 with the clearance C transiently increasing. As the gap 52 opens during the transient burst, the leakage flow therethrough will increase and cause the outer and inner rings 48, 50 to return to a common temperature causing the gap 52 to close and return to its nominal steady state clearance. This provides self correction of the gap 52 which is caused to return to its steady state clearance following the transient burst.

In a rapid deceleration, or speed chop, of the rotor disk 14 during operation, the fast responding inner flowpath 36*a* decreases in diameter, with again the seal support 42 isolating the outer ring 48 from this diameter reduction. However, the outer ring 48 will be cooled by the cooling air 20 for reducing its temperature faster than the reduction in temperature of the inner ring 50 causing the gap 52 to transiently close shut. Heat conduction between the transiently abutting outer and inner rings 48, 50 causes the rings to again assume a common temperature reopening the gap 52 and returning it to the nominal steady state clearance. Again, this provides a self correcting feature in a speed chop.

Since the outer and inner rings 48, 50 only contact each other in the transient speed chop condition, they experience very little wear during operation and enjoy a suitably long useful life. The one-piece seal support 42 and outer ring 48 is a simple component readily manufactured which provides with the inner ring 50 an improved seal having a known amount of small leakage which is readily accommodated in the design of the engine for improving efficiency over the operating life thereof. The seal support 42 simply accommodates both radial and axial differential thermal movement between the inner flowpath 36*a* and the inner band 24*a* at the bearing support 28 without the need for conventional tongue-in-groove radial seals or sliding axial seals found in conventional designs.

Figure 4:
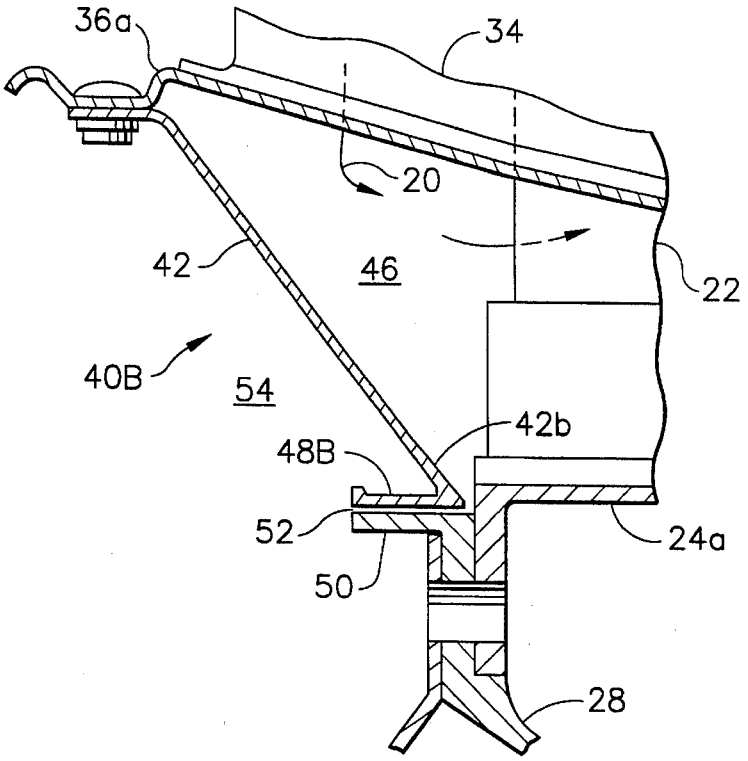
FIG. 4 is an enlarged, elevational, partly sectional view of a static seal in accordance with a second embodiment of the present invention.

FIG. 4 illustrates a second embodiment of the seal designated 40B in which the seal support 42 is again directly joined to the outer ring, designated 48B, but in this case it is joined to the aft end thereof closest to the inner band 24*a*. The outer ring 48B therefore extends axially inwardly in a forward direction from the support distal end 42*b* to define an acute intersection angle therewith for isolating the outer ring 48*b* from the pressure and temperature of the cooling air 20 in the inner chamber 46. Both the outer and inner rings 48B, 50 are in direct flow communication with the cooling air 20 discharged from the gap 52. In this way, both the outer and inner rings 48B, 50 experience the same temperature in the outer chamber 54 for ensuring more closely matched thermal expansion and contraction thereof for reducing radial variations in the gap 52 due to temperature.

Figure 5:
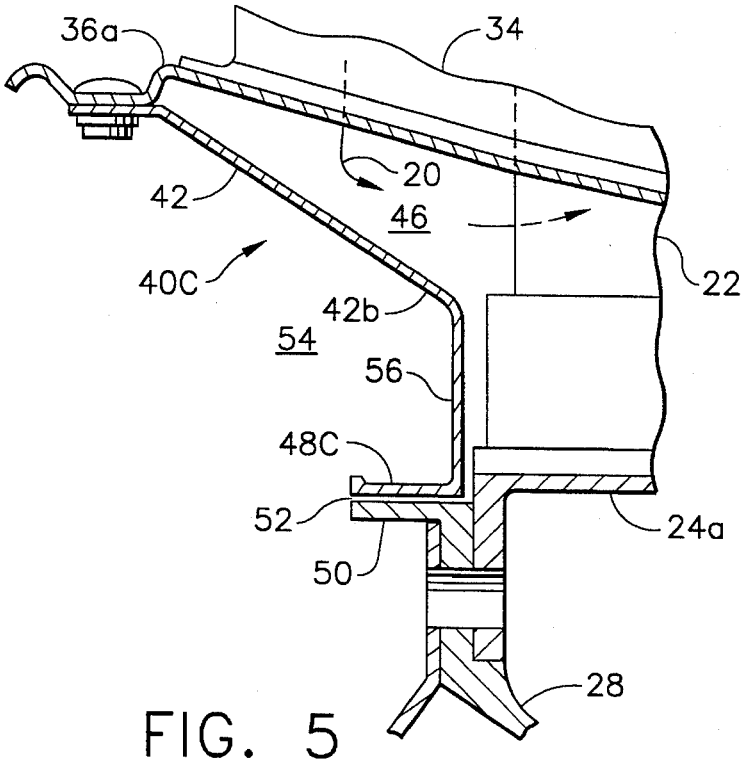
FIG. 5 is an enlarged, elevational, partly sectional view of a static seal in accordance with a third embodiment of the present invention.

FIG. 5 illustrates yet another embodiment of the seal, designated 40C, in accordance with the present invention which eliminates closure of the gap 52 due to pressure. In this embodiment, an annular flat plate 56 extends radially outwardly from the outer ring, designated 48C, to the distal end 42*b* of the seal support 42. The radial plate 56 is preferably formed integrally with the seal support 42 and the outer ring 48C. The radial plate 56 rigidly supports the outer ring 48C in the radial direction to restrain positive differential pressure of the cooling air 20 across the seal support 42 from the inner chamber 46 from radially reducing the gap 52. Although the pressure force acts atop the seal plate 42, the radial plate 56 is radially rigid and therefore does not allow the outer ring 48C to decrease radially in diameter due to the pressure force alone. The pressure force acting on the plate 56 itself is directed in the axial forward direction and do not therefore affect the diameter of the outer ring 48C.

In the exemplary embodiment illustrated in FIG. 5, the radial plate 56 is joined to the aft end of the outer ring 48C so that both the outer ring 48C and the inner ring 50 are exposed to the same temperature within the outer chamber 54 like the embodiment illustrated in FIG. 4. In yet another embodiment (not shown), the radial plate 56 could instead be integrally joined with the forward end of the outer ring 48C in a manner similar to the embodiment illustrated in FIG. 3.

In all the embodiments disclosed above, the seal provided by the controlled gap 52 is effected by two separately manufactured components, with the seal support 42 and outer ring 48 being a one-piece component, and the inner ring 50 being a separate component joined, for example, to the end of the bearing support 28. The inner ring 50 may itself be a discrete component joined to the inner band 24*a*, or it may form an integral extension of the inner band 24*a* itself if desired.

The conical seal support 42 effectively uncouples or isolates the radial expansion and contraction movement of the inner flowpath 36*a* to which it is attached from the inner band 24*a* and bearing support 28 which experience differential thermal movement relative thereto during operation of the engine. The various embodiments disclosed above effectively utilize pressure, temperature, or both for ensuring a controlled small gap 52 between the outer and inner rings of the seal. And, wear during operation is effectively eliminated since steady state operation of the seal 40 provides a relatively small, controlled gap 52 between the outer and inner rings without frictional contact therebetween.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. In a turbine frame including a plurality of struts joined to a radially inner band, and an annular inner flowpath disposed adjacent to the inner band and over which is flowable combustion gases, said inner flowpath being supported by the struts for unrestrained differential thermal movement therewith, a seal for confining cooling air channeled between said inner flowpath and said inner band comprising:

a frustoconical support having a proximal end fixedly coaxially joined to said inner flowpath, and a smaller diameter distal end, and a portion of said support spaced from said inner flowpath to define a chamber therewith for receiving said cooling air;

a radially outer ring integrally coaxially joined with said support distal end; and a radially inner ring fixedly joined to said inner band coaxially with said outer ring and spaced radially inwardly thereof to define a gap therebetween sized for limiting leakage of said cooling air from said chamber.

2. A seal according to claim 1 wherein said seal support has an acute cone angle sized to isolate said outer ring from thermal increase in diameter of said seal support proximal end for reducing radial expansion of said gap.

3. A seal according to claim 2 wherein said outer and inner rings are cylindrical and said gap extends axially therebetween.

4. A seal according to claim 3 wherein said seal support and outer ring have thicknesses selected to provide radial flexibility for allowing positive differential pressure of said cooling air across said seal support from said chamber to elastically decrease diameter of said outer ring to correspondingly radially decrease said gap.

5. A seal according to claim 3 wherein said outer and inner rings have substantially equal cross sectional thermal mass area for matching thermal movement response thereof.

6. A seal according to claim 3 wherein said outer ring has a lower coefficient of thermal expansion than said inner ring for decreasing said gap at increasing temperature.

7. A seal according to claim 3 wherein said outer ring is integrally joined at one end directly with said seal support distal end, and extends axially outwardly therefrom for defining in part said chamber.

8. A seal according to claim 3 wherein said outer ring is integrally joined at one end directly with said seal support distal end, and extends axially inwardly therefrom for isolating said outer ring from said chamber, with both said outer and inner rings being in direct flow communication with cooling air discharged from said gap.

9. A seal according to claim 3 further comprising an annular plate extending radially outwardly from said outer ring to said seal support distal end for rigidly supporting said outer ring to restrain positive differential pressure of said cooling air across said seal support from said chamber from radially reducing said gap.

10. A seal according to claim 3 wherein said cone angle is within a range of about 30°–60°.

* * * * *